US008813692B2

(12) United States Patent
Bialas et al.

(10) Patent No.: US 8,813,692 B2
(45) Date of Patent: Aug. 26, 2014

(54) SYSTEM AND METHOD FOR DETERMINING COOLANT FLOW IN AN ENGINE

(75) Inventors: Daniel A. Bialas, Ann Arbor, MI (US); Igor Anilovich, Walled Lake, MI (US); Morena Bruno, Chivasso (IT); Michele Bilancia, Turin (IT)

(73) Assignee: GM Global Technology Operations LLC

( * ) Notice: Subject to any disclaimer, the term of this patent is extended or adjusted under 35 U.S.C. 154(b) by 632 days.

(21) Appl. No.: 13/111,318

(22) Filed: May 19, 2011

(65) Prior Publication Data

US 2012/0296547 A1 Nov. 22, 2012

(51) Int. Cl.
*F01P 9/00* (2006.01)

(52) U.S. Cl.
USPC ..... 123/41.01; 123/41.05

(58) Field of Classification Search
CPC ..... F01P 3/00; F01P 3/12
USPC ..... 123/41.01, 41.02, 41.05
See application file for complete search history.

(56) References Cited

U.S. PATENT DOCUMENTS

| | | | | |
|---|---|---|---|---|
| 6,169,953 | B1 | 1/2001 | Panoushek et al. | |
| 6,397,820 | B1 * | 6/2002 | Novak et al. | 123/480 |
| 7,409,928 | B2 * | 8/2008 | Rizoulis et al. | 123/41.01 |
| 7,997,510 | B2 * | 8/2011 | Pavia et al. | 239/127.3 |
| 8,224,517 | B2 | 7/2012 | Eser et al. | |
| 2012/0215397 | A1 * | 8/2012 | Anilovich et al. | 701/30.8 |
| 2013/0089436 | A1 * | 4/2013 | Bialas et al. | 417/32 |

OTHER PUBLICATIONS

U.S. Appl. No. 13/269,048, Oct. 7, 2011, Bialas et al.
U.S. Appl. No. 13/606,565, Sep. 7, 2012, Levijoki.
Non-Final Office Action dated Jan. 6, 2014 in U.S. Appl. No. 13/269,048; 6 pages.

* cited by examiner

*Primary Examiner* — John Kwon

(57) ABSTRACT

A system includes a temperature determination module and a flow determination module. The temperature determination module determines an engine coolant temperature based on input received from an engine coolant temperature sensor and determines an engine material temperature based on input received from an engine material temperature sensor. The engine coolant temperature is a temperature of coolant in an engine, and the engine material temperature is a temperature of at least one of an engine block and a cylinder head. The flow determination module selectively determines coolant flow through the engine based on the engine coolant temperature and the engine material temperature.

20 Claims, 4 Drawing Sheets

SYSTEM AND METHOD FOR DETERMINING COOLANT FLOW IN AN ENGINE

FIELD

The present disclosure relates to engine cooling systems, and more particularly, to systems and methods for determining coolant flow through an engine.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Typically, engine water pumps are belt-driven centrifugal pumps that circulate coolant through an engine to cool the engine. Coolant is received through an inlet located near the center of a pump, and an impeller in the pump forces the coolant to the outside of the pump. Coolant is received from a radiator, and coolant exiting the pump flows through an engine block and a cylinder head before returning to the radiator.

In conventional water pumps, the impeller is always engaged with a belt-driven pulley. Thus, the pump circulates coolant through the engine whenever the engine is running. In contrast, switchable water pumps include a clutch that engages and disengages the impeller to switch the pumps on and off, respectively. When an engine is initially started, the pumps may be switched off to reduce the time required to warm up the engine and to improve fuel economy. However, the impeller may not disengage as commanded due to, for example, a clutch stuck in an engaged position.

SUMMARY

A system includes a temperature determination module and a flow determination module. The temperature determination module determines an engine coolant temperature based on input received from an engine coolant temperature sensor and determines an engine material temperature based on input received from an engine material temperature sensor. The engine coolant temperature is a temperature of coolant in an engine, and the engine material temperature is a temperature of at least one of an engine block and a cylinder head. The flow determination module selectively determines coolant flow through the engine based on the engine coolant temperature and the engine material temperature.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
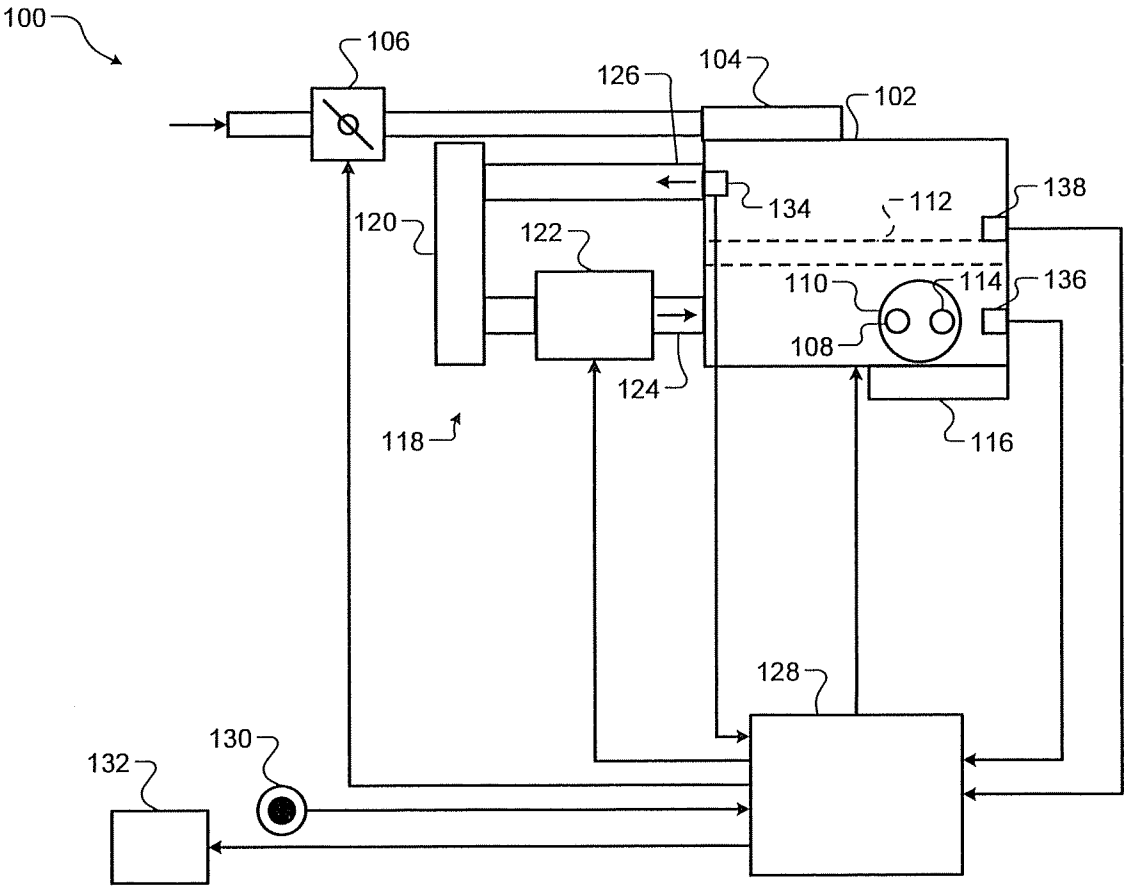
FIG. 1 is a functional block diagram of an example engine system according to the principles of the present disclosure.

The following description is merely illustrative in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors or a group of execution engines. For example, multiple cores and/or multiple threads of a processor may be considered to be execution engines. In various implementations, execution engines may be grouped across a processor, across multiple processors, and across processors in multiple locations, such as multiple servers in a parallel processing arrangement. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

A system and method according to the present disclosure measures an engine coolant temperature (ECT) and an engine material temperature (EMT), and determines whether coolant is flowing in an engine based on the ECT and the EMT. The EMT is the temperature of the material from which the engine is made. While an engine is warming up after the engine is started, the ECT and the EMT may increase at about the same rate when coolant is flowing in the engine. In contrast, the EMT may increase at a greater rate than the ECT when coolant is not flowing in the engine. Thus, coolant flow may be determined without a coolant flow sensor, reducing vehicle costs.

Referring to FIG. 1, a functional block diagram of an example engine system 100 is presented. An engine 102 generates drive torque for a vehicle. While the engine 102 is shown and will be discussed as a spark-ignition, the engine 102 may be another suitable type of engine, such as a compression-ignition engine. Air is drawn into the engine 102 through an intake manifold 104. Airflow into the engine 102 may be varied using a throttle valve 106. One or more fuel injectors, such as a fuel injector 108, mix fuel with the air to form an air/fuel mixture. The air/fuel mixture is combusted within cylinders of the engine 102, such as a cylinder 110. Although the engine 102 is depicted as including one cylinder, the engine 102 may include more than one cylinder.

The cylinder 110 includes a piston (not shown) that is mechanically linked to a crankshaft 112. One combustion cycle within the cylinder 110 may include four phases: an intake phase, a compression phase, a combustion phase, and an exhaust phase. During the intake phase, the piston moves toward a bottommost position and draws air into the cylinder 110. During the compression phase, the piston moves toward a topmost position and compresses the air or air/fuel mixture within the cylinder 110.

During the combustion phase, spark from a spark plug 114 ignites the air/fuel mixture. The combustion of the air/fuel mixture drives the piston back toward the bottommost position, and the piston drives rotation of the crankshaft 112. Resulting exhaust gas is expelled from the cylinder 110 through an exhaust manifold 116 to complete the exhaust phase and the combustion cycle. The engine 102 outputs torque to a transmission (not shown) via the crankshaft 112.

A cooling system 118 for the engine 102 includes a radiator 120 and a water pump 122. The radiator 120 cools coolant that flows through the radiator 120, and the water pump 122 circulates coolant through the engine 102 and the radiator 120. Coolant flows from the radiator 120 to the water pump 122, from the water pump 122 to the engine 102 through an inlet hose 124, and from the engine 102 back to the radiator 120 through an outlet hose 126.

The water pump 122 may be a centrifugal pump that includes an impeller engaged with a pulley (not shown) driven by a belt (not shown) connected to the crankshaft 112. Coolant may enter the water pump 122 through an inlet located near the center of the water pump 122, and the impeller may force the coolant radially outward to an outlet located at the outside of the water pump 122. The water pump 122 may be a switchable water pump including a clutch that disengages and engages the impeller and the pulley when the water pump 122 is switched off and on, respectively. Alternatively, the water pump may be an electric pump.

An engine control module (ECM) 128 controls the throttle valve 106, the fuel injector 108, and the spark plug 114, and the water pump 122 based on inputs received from an ignition switch 130 and one or more sensors. The ignition switch 130 may be a key or a button that a driver turns or presses to start the engine 102. The ECM 128 may activate a malfunction indicator light (MIL) 132 based on the inputs received. When activated, the MIL 132 notifies the driver of a malfunction in the engine system 100. For example, if the water pump 122 is a switchable water pump, the ECM 128 may activate the MIL 132 to notify the driver when the water pump 122 is stuck on. Although the MIL 132 is referred to as a light, the MIL 132 may notify the driver of a fault using mediums other than light, including sound and vibration.

The sensors may include an engine coolant temperature (ECT) sensor 134, an engine material temperature (EMT) sensor 136, and a crankshaft position (CPS) sensor 138. The ECT sensor 134 measures the temperature of coolant in the engine 102. The ECT 134 may be positioned in the coolant near the outlet of the engine 102. The EMT sensor 136 measures the temperature of the material (e.g., steel) from which the engine 102 is made. The EMT sensor 126 may be positioned in the material of an engine block or a cylinder head included in the engine 102. The CPS sensor 138 measures the position of the crankshaft 112. The ECM 128 may determine the speed of the engine 102 based on the position of the crankshaft 112.

Figure 2:
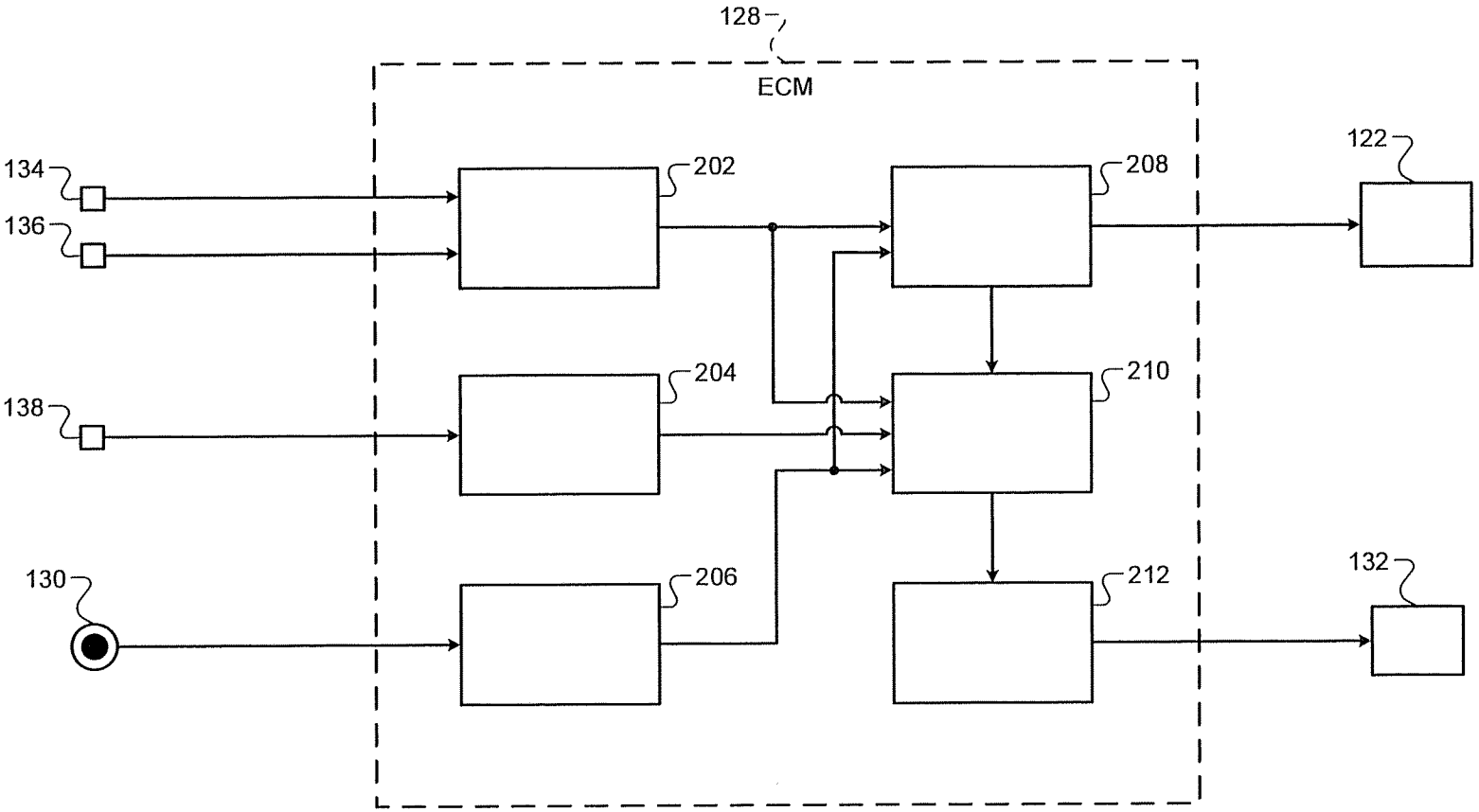
FIG. 2 is a functional block diagram of an example control system according to the principles of the present disclosure.

Referring to FIG. 2, the ECM 128 includes a temperature determination module 202, an energy estimation module 204, and a runtime determination module 206. The temperature determination module 202 determines the engine coolant temperature and the engine material temperature based on inputs received from the ECT sensor 134 and the EMT sensor 136. The temperature determination module 202 outputs the engine coolant temperature and the engine material temperature.

The energy estimation module 204 estimates an amount of energy that is input into the cooling system 118. The energy estimation module 204 may estimate the input energy based on an indicated power of the engine 102, an ambient temperature, and/or a vehicle speed. The energy estimation module 204 may determine the indicated power based on an indicated torque and the engine speed received from the CPS sensor 138. The energy estimation module 204 may estimate the indicated torque based on intake airflow, spark timing, fuel flow, and/or the engine speed. The energy estimation module 204 outputs the input energy.

The energy estimation module 204 may estimate the input energy on an iterative basis and sum the input energy between control loop iterations to obtain a total input energy. For example, the energy estimation module 204 may estimate the input energy between a previous iteration and a present iteration, and add the input energy between iterations to a previous total input energy to obtain a present total input energy. The energy estimation module 204 may start estimating the input energy at engine startup and continue accumulating the input energy during an engine warm-up period. The period between the control loop iterations may be one second. Thus, the energy estimation module 204 may estimate the input energy every second.

The runtime determination module 206 determines an engine runtime. The engine runtime is an operating period of the engine 102 that starts when the engine 102 is initially started and continues until the engine 102 is stopped. The runtime determination module 206 may determine the engine runtime based on an input received from the ignition switch 130. For example, the runtime determination module 206 may start incrementing the engine runtime when the driver starts the engine 102 and stop incrementing the engine runtime when the driver stops the engine 102. The runtime determination module 206 outputs the engine runtime.

A pump activation module 208 activates and deactivates the water pump 122 by commanding the water pump 122 on and off, respectively. The pump activation module 208 may activate and deactivate the water pump 122 based on the engine material temperature, the engine coolant temperature, the engine runtime, and/or other parameters such as a request generated by a heating, ventilation, and air conditioning (HVAC) system. The pump activation module 208 may deactivate the water pump 122 when the engine 102 is initially started and the engine material temperature is less than a predetermined temperature. The pump activation module 208 may activate the water pump 122 when the engine material temperature is greater than the predetermined temperature.

The pump activation module 208 may operate in a basic mode in which the water pump 122 remains activated for a remainder of a trip (i.e., until the engine 102 is stopped). Alternatively, the pump activation module 208 may operate in an advanced mode in which the water pump 122 is deactivated and activated throughout the trip. The pump activation module 208 outputs a signal indicating whether the water pump 122 is activated or deactivated.

A flow determination module 210 determines coolant flow through the engine 102 based on the engine coolant temperature and the engine material temperature. The flow determination module 210 may determine whether coolant is flowing through the engine 102 and/or an amount of coolant that is flowing through the engine 102. The flow determination module 210 may determine the coolant flow when the water pump 122 is commanded off, when the engine 102 is started, and/or when the engine runtime is greater than a predetermined period (e.g., between 20 seconds and 30 seconds). The predetermined period may allow coolant to circulate through the engine 102, allow combustion to heat the engine material, and allow the sensors 134, 136 to reach a temperature at which their output is accurate.

The flow determination module 210 may determine the coolant flow based on a difference between the engine material temperature and the engine coolant temperature. As coolant flows through and absorbs heat from the engine 102, increases in the engine coolant temperature offset increases in the engine material temperature. Thus, during an engine warm-up period, the difference between the engine material temperature and the engine coolant temperature increases when coolant is not flowing through the engine 102. In contrast, the difference between the engine material temperature and the engine coolant temperature is relatively constant when coolant is flowing through the engine 102 during the engine warm-up period.

The flow determination module 210 may determine the coolant flow based on a ratio of a difference between the engine coolant temperature and the engine material temperature to the input energy. This ratio may be determined based on $$r=[(EMT-ECT)-(EMT_0-ECT_0)]/Energy^k, \quad (1)$$

where r is the ratio, EMT is the engine material temperature at a present time, ECT is the engine coolant temperature at the present time, $EMT_0$ is the engine material temperature at a previous time, $ECT_0$ is the engine coolant temperature at the previous time, Energy is the input energy, and k is a constant.

The previous time may be when the engine 102 is initially started. Energy may be the amount of energy input into the cooling system 118 during a period between the previous time and the present time. The constant k may be predetermined to produce a ratio r having a constant value (e.g., 1) when coolant is not flowing through the engine 102. In this regard, the ratio r may be referred to as a normalized ratio. When coolant is flowing through the engine 102, the ratio r may decrease.

The flow determination module 210 may determine that coolant is not flowing through the engine 102 when the ratio is greater than a predetermined value. Conversely, the flow determination module 210 may determine that coolant is flowing through the engine 102 when the ratio is less than or equal to the predetermined value. The predetermined value may be based on a maximum ratio observed during testing while the engine 102 is warming up and coolant is flowing through the engine 102.

The flow determination module 210 may determine the ratio every control loop iteration. As discussed above, the period between control loop iterations may be one second. Thus, the flow determination module 210 may identify a change in coolant flow through the engine 102 within one second of when the change actually occurs. The flow determination module 210 outputs a signal indicating whether coolant is flowing through the engine 102.

An indicator activation module 212 activates the MIL 132 based on whether coolant is flowing through the engine 102. As discussed above, the pump activation module 208 may deactivate the water pump 122 when the engine 102 is initially started. The pump activation module 208 may deactivate the water pump 122 to improve fuel economy. However, the water pump 122 may not switch off as commanded due to, for example, debris stuck in the clutch that disengaged the impeller of the water pump 122.

The indicator activation module 212 may activate the MIL 132 when coolant is flowing through the engine 102, indicating that the water pump 122 is stuck on. When activated, the MIL 132 provides notification that the water pump 122 is stuck on. In turn, the water pump 122 may be repaired or replaced, and the fuel economy improvements achieved by deactivating the water pump 122 may again be realized.

Thus, the control system described above enables a malfunction in a water pump to be identified without the added cost of a coolant flow sensor. In addition, since the normalized ratio is physics-based, identified malfunctions may be directly correlated with coolant flow. While the control system may include one or more modules that identify circuit faults in an output driver of a water pump control module, such as the pump activation module 208, the control system may also identify faults in the water pump.

Although the control system is described with reference to a switchable water pump, the control system may be used to identify faults in a conventional water pump. For example, the control system may determine when coolant flow is less than expected, indicating a malfunction in a conventional water pump. In addition, the control system may notify a driver, decrease engine output power, and/or shutdown an engine when the coolant flow is less than expected.

Figure 3:
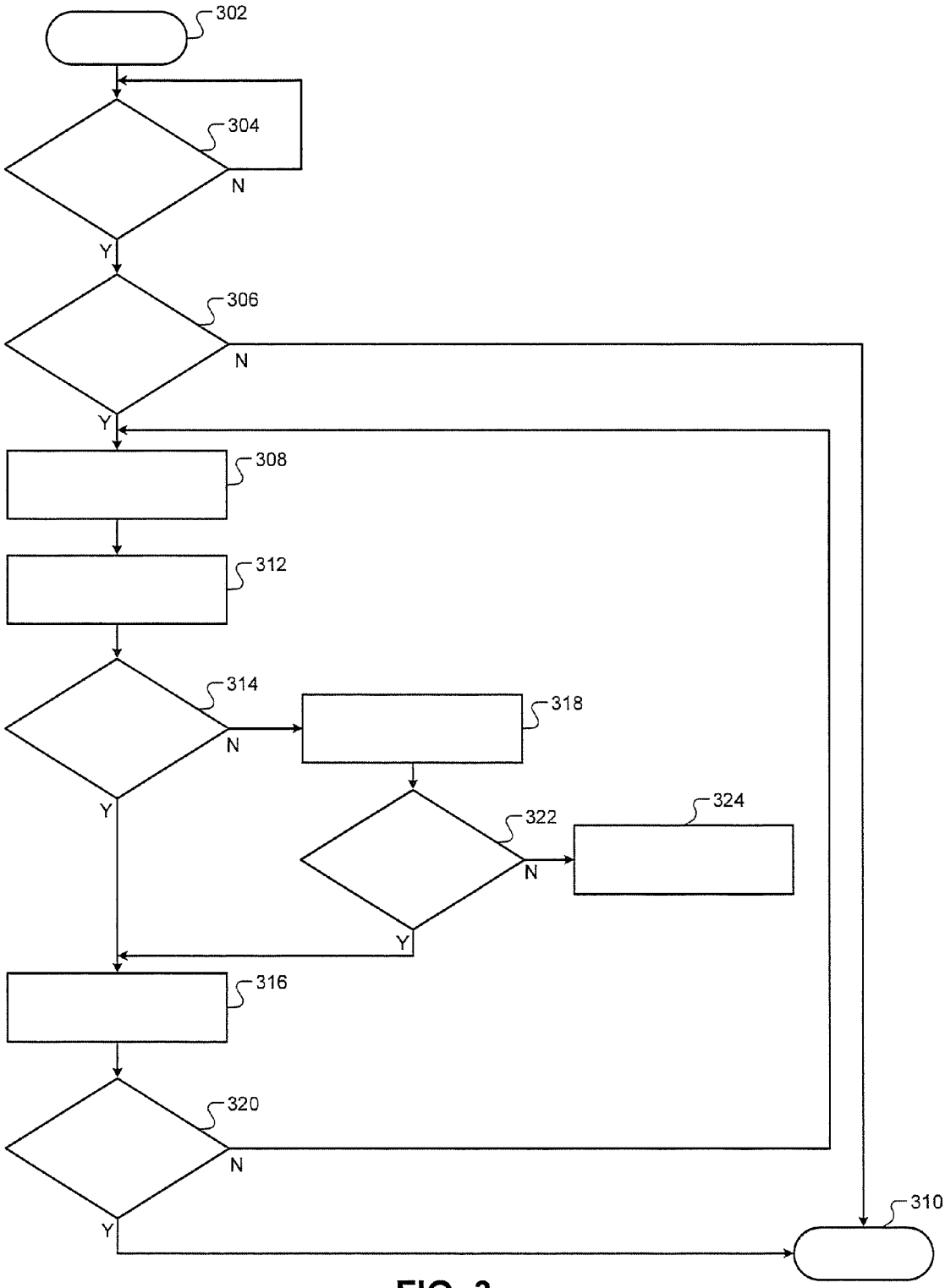
FIG. 3 is a flowchart illustrating an example control method according to the principles of the present disclosure.

Referring now to FIG. 3, a method for determining coolant flow in an engine begins at 302. Determining coolant flow in the engine may include determining whether coolant is flowing through the engine and/or determining an amount of coolant flowing through the engine. At 304, the method determines whether a switchable water pump is commanded off. If 304 is true, the method continues. If 304 is false, the method continues to determine whether the switchable water pump is commanded off.

At 306, the method determines whether an engine material temperature is less than a predetermined temperature. The method may determine coolant flow based on an increase in an engine material temperature during an engine warm-up period. Thus, the predetermined temperature may ensure that the increase in the engine material temperature is sufficient for a determination of coolant flow. If 306 is true, the method continues at 308. If 306 is false, the method ends at 310.

At 308, the method estimates an amount of energy that is input into a cooling system of the engine. The method may estimate the input energy based on an indicated power of the engine, an ambient temperature, and/or a vehicle speed. The method may estimate the indicated power based on intake airflow, spark timing, fuel flow, and/or the engine speed.

At 312, the method calculates a normalized ratio of a difference between the engine material temperature and the engine coolant temperature to the input energy. The method may calculate first and second differences between the engine material temperature and the engine coolant temperature at first and second times, respectively. The normalized ratio may be a ratio of a third difference between the first difference and the second difference to the input energy raised to the power of a normalizing constant.

At 314, the method determines whether the normalized ratio is greater than a predetermined value. The predetermined value may be based on a maximum ratio observed during an engine warm-up period while coolant is flowing through the engine. If 314 is true, the method continues at 316. If 314 is false, the method continues at 318. At 316, the method increments a sample count. At 320, the method determines whether the sample count is greater than or equal to a sample count limit (e.g., 200). If 320 is true, the method ends at 310. If 320 is false, the method continues at 308.

At 318, the method increments a fail count. At 322, the method determines whether the fail count is less than a fail count limit (e.g., 100). If 322 is true, the method continues at 316. If 322 if false, the method indicates a pump fault at 324. Thus, the method indicates a pump fault when the fail count is greater than or equal to the fail count limit before the sample count is greater than or equal to the sample count limit.

The method described above may be performed once per trip, which may be an event that starts and stops when a driver starts and stops an engine, respectively. A control loop iteration from 308, to 320, and back to 308 may be one second in duration. Thus, if the sample count limit is 200, then the method may continuously determine coolant flow in the engine for 200 seconds. The sample count limit may be adjusted to adjust this period to a value between 1 minute and 5 minutes (e.g., 3 minutes).

Figure 4:
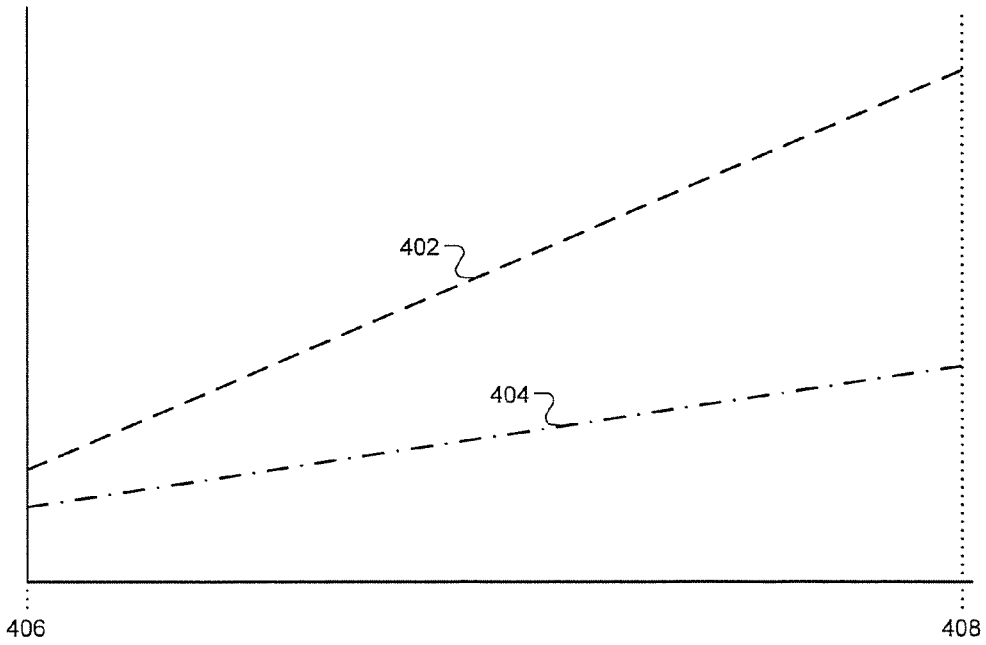
FIG. 4 is a graph illustrating example engine temperatures during an engine warm-up period when a switchable water pump is switched off as commanded.

Referring to FIG. 4, an engine material temperature 402 and an engine coolant temperature 404 correspond to an engine warm-up period when no coolant is flowing through an engine (e.g., when a switchable water pump is switched off). The x-axis represents time and the y-axis represents temperature. The engine warm-up period starts at 406, when the engine is initially started, and ends at 408.

Since no coolant is flowing through the engine, the engine material temperature 402 increases at a greater rate than the engine coolant temperature 404. In turn, the difference between the engine material temperature 402 and the engine coolant temperature 404 increases during the engine warm-up period. However, the amount of energy produced by combustion in the engine also increases during the engine warm-up period. Thus, the normalized ratio remains at a constant value (e.g., 1) throughout the engine warm-up period.

Figure 5:
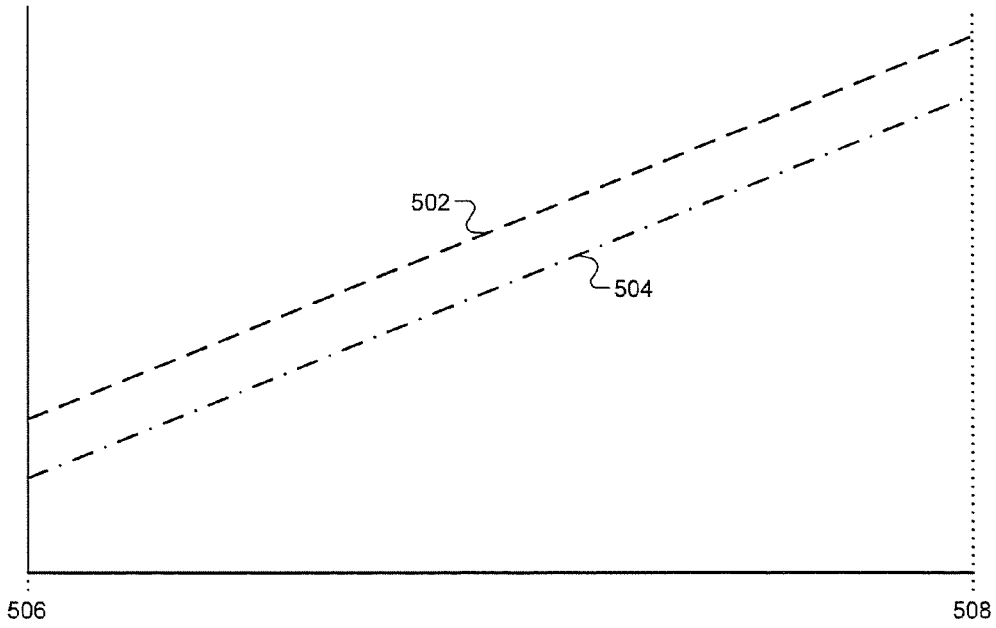
FIG. 5 is a graph illustrating example engine temperatures during an engine warm-up period when a switchable water pump is not switched off as commanded.

Referring to FIG. 5, an engine material temperature 502 and an engine coolant temperature 504 correspond to an engine warm-up period when coolant is flowing through an engine (e.g., when a switchable water pump is switched or stuck on). The x-axis represents time and the y-axis represents temperature. The engine warm-up period starts at 506, when the engine is initially started, and ends at 508.

Since coolant is flowing through the engine, the engine material temperature 402 and the engine coolant temperature 404 increase at about the same rate. In turn, the difference between the engine material temperature 502 and the engine coolant temperature 504 is relatively constant during the engine warm-up period. Since the amount of energy produced by combustion increases during the engine warm-up period, the normalized ratio decreases throughout the engine warm-up period.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A system comprising:

a temperature determination module that determines an engine coolant temperature based on input received from an engine coolant temperature sensor and determines an engine material temperature based on input received from an engine material temperature sensor, wherein the engine coolant temperature is a temperature of coolant in an engine, and the engine material temperature is a temperature of at least one of an engine block and a cylinder head; and a flow determination module that selectively determines coolant flow through the engine based on the engine coolant temperature and the engine material temperature.

2. The system of claim 1, wherein the flow determination module determines the coolant flow when a switchable water pump in fluid communication with the engine is commanded off.

3. The system of claim 1, wherein the flow determination module determines the coolant flow when the engine is started and the engine material temperature is less than a predetermined temperature.

4. The system of claim 1, wherein the flow determination module determines the coolant flow when an operating period of the engine is greater than a predetermined period, wherein the operating period starts when the engine is initially started.

5. The system of claim 1, wherein the flow determination module determines the coolant flow based on a difference between the engine coolant temperature and the engine material temperature.

6. The system of claim 1, wherein the flow determination module determines the coolant flow based on a first difference between the engine coolant temperature and the engine material temperature at a first time and a second difference between the engine coolant temperature and the engine material temperature at a second time.

7. The system of claim 6, wherein the flow determination module determines the coolant flow based on an amount of energy input into a cooling system of the engine during a period between the first time and the second time.

8. The system of claim 7, further comprising an energy estimation module that estimates the input energy based on an indicated power of the engine.

9. The system of claim 7, wherein the flow determination module determines that coolant is flowing through the engine when a ratio of a third difference between the first difference and the second difference to the input energy is less than or equal to a predetermined value.

10. The system of claim 9, further comprising an indicator activation module that activates a malfunction indicator light when coolant is flowing through the engine.

11. A method comprising:

determining an engine coolant temperature based on input received from an engine coolant temperature sensor, wherein the engine coolant temperature is a temperature of coolant in an engine;

determining an engine material temperature based on input received from an engine material temperature sensor, wherein the engine material temperature is a temperature of at least one of an engine block and a cylinder head; and selectively determining coolant flow through the engine based on the engine coolant temperature and the engine material temperature.

12. The method of claim 11, further comprising determining the coolant flow when a switchable water pump in fluid communication with the engine is commanded off.

13. The method of claim 11, further comprising determining the coolant flow when the engine is started and the engine material temperature is less than a predetermined temperature.

14. The method of claim 11, further comprising determining the coolant flow when an operating period of the engine is greater than a predetermined period, wherein the operating period starts when the engine is initially started.

15. The method of claim 11, further comprising determining the coolant flow based on a difference between the engine coolant temperature and the engine material temperature.

16. The method of claim 11, further comprising determining the coolant flow based on a first difference between the engine coolant temperature and the engine material temperature at a first time and a second difference between the engine coolant temperature and the engine material temperature at a second time.

17. The method of claim 16, further comprising determining the coolant flow based on an amount of energy input into a cooling system of the engine during a period between the first time and the second time.

18. The method of claim 17, further comprising estimating the input energy based on an indicated power of the engine.

19. The method of claim 17, further comprising determining that coolant is flowing through the engine when a ratio of a third difference between the first difference and the second difference to the input energy is less than or equal to a predetermined value.

20. The method of claim 19, further comprising activating a malfunction indicator light when coolant is flowing through the engine.

* * * * *